US006003449A

United States Patent [19]

Manidis

[11] Patent Number: 6,003,449

[45] Date of Patent: Dec. 21, 1999

[54] ERGONOMICALLY DESIGNED CONTAINER FOR HEAVY GOODS

[75] Inventor: Andrew Charles Manidis, Atlanta, Ga.

[73] Assignee: Clip-Lok International Limited, British, Virgin Islands (Br.)

[21] Appl. No.: 09/135,096

[22] Filed: Aug. 17, 1998

[30] Foreign Application Priority Data

Aug. 19, 1997 [ZA] South Africa ..... 97/7436

[51] Int. Cl.[6] ..... B65D 19/38

[52] U.S. Cl. ..... 108/54.1; 108/51.11

[58] Field of Search ..... 108/55.1, 56.1, 108/56.3, 54.1, 51.11, 52.1

[56] References Cited

U.S. PATENT DOCUMENTS

| | | | |
|---|---|---|---|
| 3,348,723 | 10/1967 | Wilson | 108/55.1 X |
| 3,688,968 | 9/1972 | Rathfon, III | 108/55.1 X |
| 4,062,301 | 12/1977 | Pitchford . | |
| 4,165,806 | 8/1979 | Cayton | 108/55.1 X |
| 4,453,471 | 6/1984 | Harrington et al. . | |
| 4,694,962 | 9/1987 | Taub | 108/54.1 X |
| 4,993,330 | 2/1991 | Yen | 108/56.1 |
| 5,105,746 | 4/1992 | Reynolds . | |
| 5,178,075 | 1/1993 | Kanazawa . | |
| 5,267,516 | 12/1993 | Abrahamson et al. | 108/54.1 |
| 5,546,871 | 8/1996 | Chapman | 108/54.1 |
| 5,586,666 | 12/1996 | Squitieri | 108/54.1 X |

FOREIGN PATENT DOCUMENTS

| | | | |
|---|---|---|---|
| 664558 | 6/1963 | Canada | 108/56.1 |
| 2157171 | 6/1973 | France . | |
| 2391115 | 12/1978 | France . | |

*Primary Examiner*—Jose V. Chen
*Attorney, Agent, or Firm*—Ladas & Parry

[57] ABSTRACT

An ergonomically designed collapsible container comprises a split pallet assembly having first and second detachably mountable pallet portions. The first pallet portion includes a first raised platform and defines a walk-in loading zone adjacent the first pallet portion for pre-loading the first raised platform. The second pallet portion includes a second raised platform which is co-planar with the first raised platform and which is arranged to occupy the loading zone for subsequent loading of the second raised platform after pre-loading of the first raised platform. The split pallet assembly is formed with an outer peripheral rebate for accommodating four side walls or panels which are clipped detachably both to the pallet and to one another by L-shaped clamps. The split pallet assembly allows for a relatively deep and high volume collapsible container to be manually loaded with heavy cargo such as glass goods without having to bend or stretch unnecessarily.

10 Claims, 3 Drawing Sheets

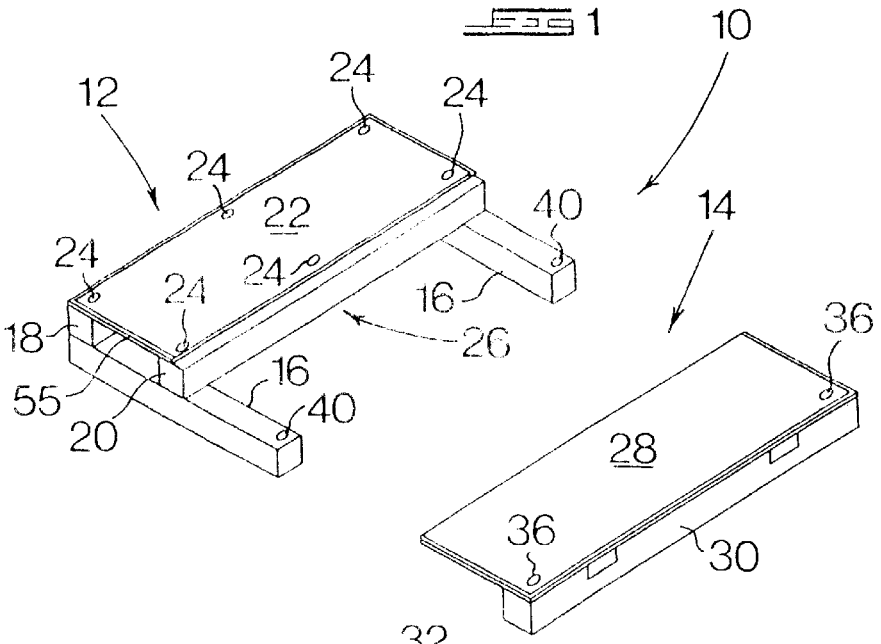
1
10
12
24
24
24
22
40
14
24
24
24
16
18
26
36
16
55
40
20
28
36
30
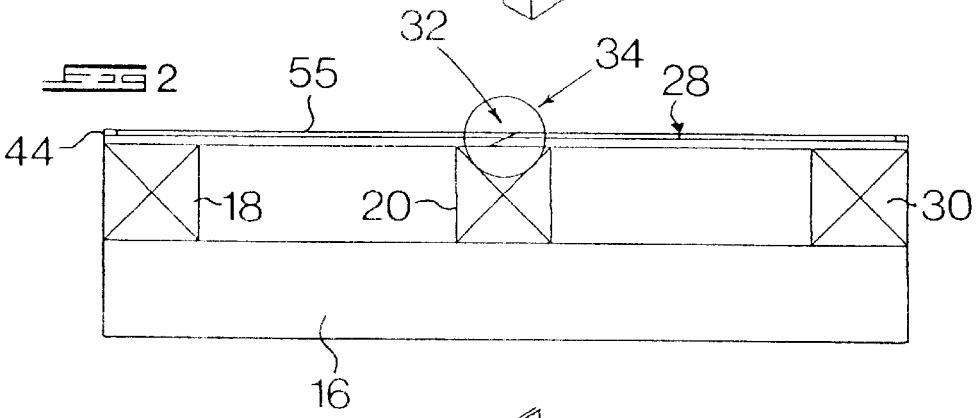
2
32
34
55
28
44
18
20
30
16
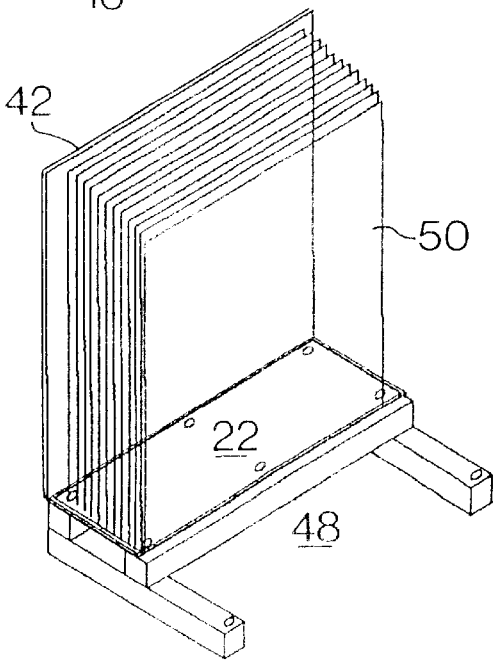
42
50
3A
22
48

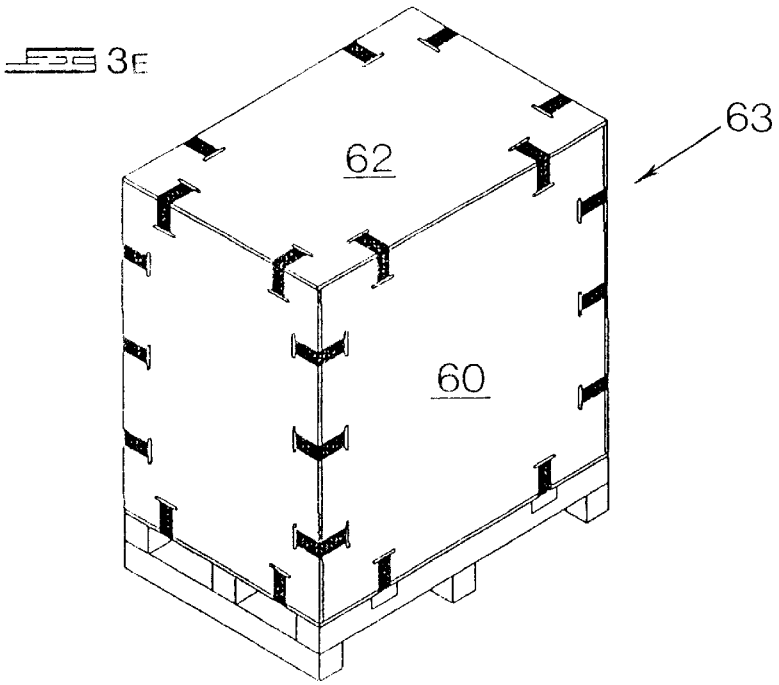
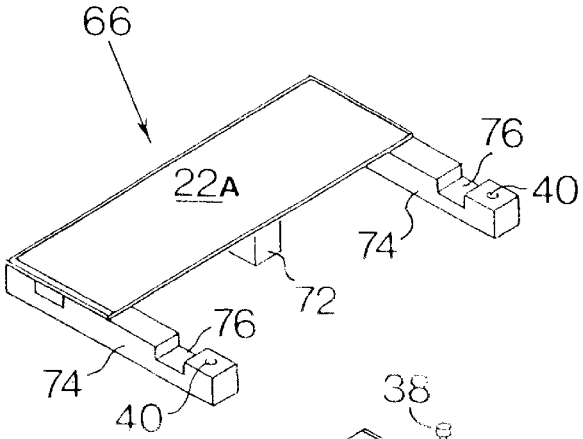
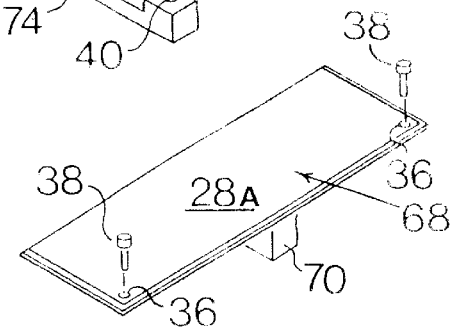
4A
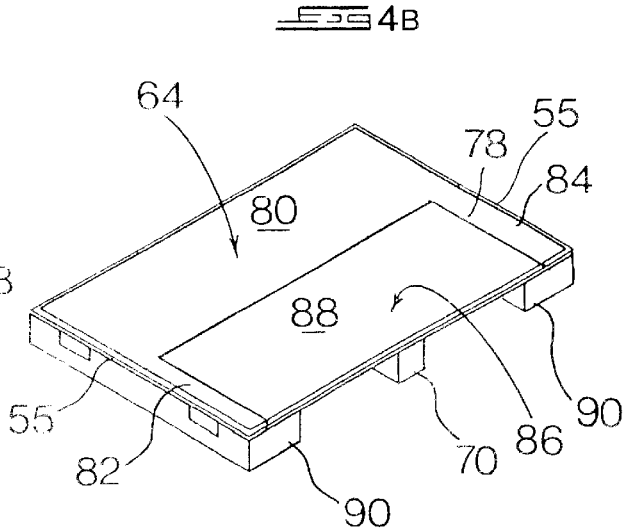

ERGONOMICALLY DESIGNED CONTAINER FOR HEAVY GOODS

BACKGROUND TO THE INVENTION

THIS invention relates to an ergonomically designed container for heavy goods, and in particular for heavy fragile goods such as glass goods.

Heavy glass goods of a flat or formed nature are normally packed by hand into collapsible containers prior to shipping. Such collapsible containers may be in the form of a base pallet, four side walls or panels and a top panel. In one type of collapsible container, which forms the subject of the applicant's U.S. Pat. No. 4,453,471, the base pallet and the side and top panels are held together by means of L-shaped clips, with the clips also being used to hold the various panels together in a collapsed or sheaved condition when the containers are being returned for re-packaging.

During the manual loading procedure, the containers are normally semi-erected, in that three of the side panels are clipped to the base pallet. The glass goods are then manually loaded onto the pallet via the opening left by the fourth side panel. After loading, the fourth side panel and the top lid are clipped into place.

Collapsible containers of the type described typically fall into the category of intermediate bulk carriers, or IBC's. In the case of the manual loading of heavy glass articles and the like, it is extremely difficult to load the articles against the side panel which lies opposite the opening. As the loader has to stretch over and bend fully to load the articles on the far side of the pallet, this results in considerable strain on the back and the concomitant potential of back injuries. This problem is not alleviated if the loader surmounts the pallet, as he still has to bend down to the level of his feet during initial loading of the far side of the container. In the past, the only way of alleviating this problem has been by the provision of smaller more accessible pallets. From a logistical viewpoint, this is far from ideal.

SUMMARY OF THE INVENTION

According to a first aspect of invention there is provided a collapsible container comprising a multi-sided base pallet assembly, and a plurality of side walls arranged to be fitted to the sides of the base pallet assembly, the base pallet assembly comprising first and second detachably mountable pallet portions, the first pallet portion including a first raised platform and defining a walk-in loading zone adjacent the first pallet portion for pre-loading the first raised platform, and the second pallet portion including a second raised platform co-planar with the first raised platform and arranged to occupy the loading zone for subsequent loading of the second raised platform after pre-loading of the first raised platform.

The invention extends to a split pallet assembly comprising first and second pallet portions and mounting means for detachably mounting together the first and second pallet portions, the first pallet portion including a first raised platform supported on a pair of outer skids and a walk-in loading zone surrounded by the first raised platform and the skids for preloading the first raised platform, and the second pallet portion including a second raised platform co-planar with the first raised platform and arranged to occupy the loading zone after pre-loading of the first raised platform for subsequent loading of the second raised platform.

According to a still further aspect of the invention there is provided a method of assembling and loading a collapsible container comprising the steps of providing a first pallet portion having a first raised platform, manually loading the first raised platform with cargo from a walk-in loading zone adjacent the first raised platform, mounting a second pallet portion fast to the first pallet portion, with a second raised platform of the second pallet portion occupying the loading zone and being substantially co-planar with the first raised platform and loading the second raised platform of the second pallet portion with cargo.

Other features of the invention are set out in the sub-claims.

The collapsible container is typically formed from wood, but other materials such as steel or injection moulded plastics may be used. In particular, the split pallet assembly may be formed from steel or a suitable rugged plastics material.

BRIEF DESCRIPTION OF THE DRAWINGS

FIG. 1 shows a perspective disassembled view of a first embodiment of a pallet assembly of the invention;

FIG. 2 shows a side view of the pallet assembly of FIG. 1 in the assembled condition;

FIGS. 3A to 3E show various steps in the erection of a collapsible container of the invention incorporating the pallet assembly of FIGS. 1 and 2; and FIGS. 4A & 4B show respective disassembled and assembled views of second and third embodiments of pallet assemblies of the invention.

DESCRIPTION OF EMBODIMENTS

Figure 3B:
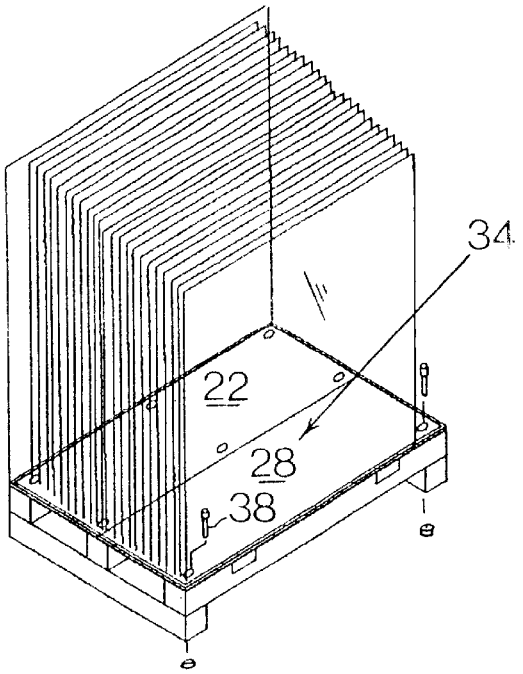

Referring, first to FIG. 1, a split pallet assembly 10 comprises a first pallet portion 12 and a second pallet portion 14. The first pallet portion 12 comprises a pair of outer base skids or supports 16 spanned by a pair of intermediate outer and central elongate wooden support beams 18 and 20 respectively. A raised semi-platform 22 is in turn bolted to the upper surfaces of the supports 18 and 20 by means of mounting bolts 24, with the outer bolts 24 serving to hold together the entire framework 26 constituted by the supports 16, 18 and 20.

The second pallet portion 14 comprises a semi-platform 28 which is mounted to a single support beam 30. It is clear from FIGS. 2 and 3B how the second pallet portion 14 mates snugly with the first pallet portion 12 via a slanting lap joint 32, with the result that the semi-platform 22 is co-planar with the semi-platform 28 so as to form a single co-planar load platform 34.

The lap joint 32 secures the inner mating edges of the platform against vertical movement, thereby reducing the number of securing bolts 38 required to maintain the plaf-form halves in a coplanar configuration. The edge corners of the platform 28 are formed with apertures 36 for receiving mounting bolts 38 which pass through both the apertures 36 and registering apertures 40 extending through the free ends of the skid planks 16.

Referring now to FIG. 3A, a rear panel 42 is first mounted so that its lower edge locates within a rebate 44 formed in a rear edge of the semi-platform 22. The rear panel is clipped into position using L-shaped clamps 46 of the type illustrated in FIGS. 3C and 3D, the ends of which engage with mounting slots 47 formed towards the outer peripheries of the side walls. A loading frame (not shown) is then positioned to support the rear panel and, where necessary, to angle the partly formed box back to facilitate loading. Thereafter, loading personnel are able to walk into the vacant loading zone 48 defined by the supports 16 and central beam 20 of the first pallet portion to manually load the semi-platform 22 with glass goods such as sheet glass 50.

Figure 3C:
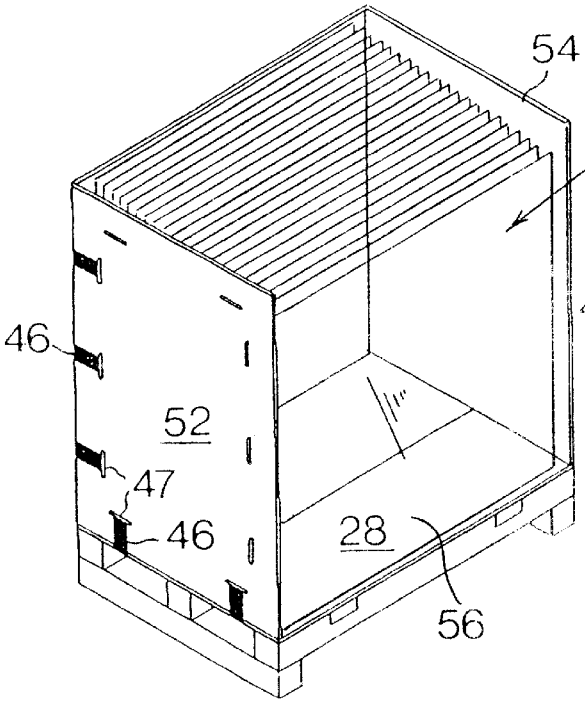
Figure 3D:
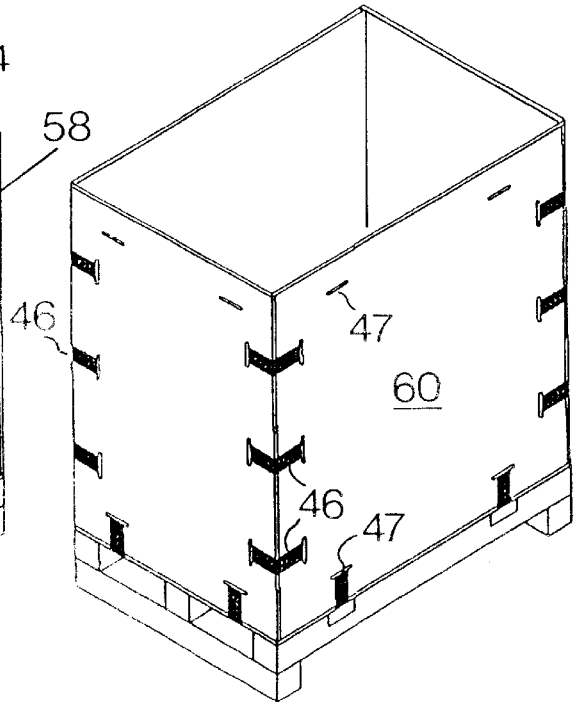

After the semi-platform has been loaded, the second pallet portion 14 is then mounted in position in the manner previously described with reference to FIGS. 2 and 3B, using the mounting bolts 38 to fasten the second pallet portion into position. The side walls 52 and 54 are then clipped into position in the manner illustrated in FIG. 3C by means of the clips 46 via side rebates 55. The loading operation is then completed by manually loading the semi-platform 28 with a stack of sheet glass 56 via the opening 58 left by the vacant remaining side wall 60. Thereafter, the remaining side wall 60 is clipped into position in the manner illustrated in FIG. 3D, and the top panel or lid 62 is then clipped into position as is shown in FIG. 3E to form the complete collapsible container 63. In an alternative loading sequence, the side walls 60 are clipped into position prior to loading of the semi-platform 28.

Referring now to FIG. 4A, an alternative embodiment of a split pallet assembly 64 is shown comprising pallet halves or portions 66 and 68. The pallet portion 66 is formed with a semi-platform 22A, and the pallet portion 68 is formed with a semi-platform 28A which is mounted to an intermediate skid plank 70. The intermediate skid plank 70 is arranged to be brought to registry with the intermediate skid plank 72 supporting the semi-platform 66, which is also supported on outer skid planks 74 formed with cut-outs 76 for receiving the tines of a fork lift truck. The pallet portion is bolted to the outer skid planks 74 in the manner previously described.

In yet another unsupported version of the invention illustrated in FIG. 4B, the intermediate skid planks 70 and 72 may be removed, in which case the second pallet portion 68 is constituted entirely by the semi-platform 28A.

It should be appreciated that the pallet can be divided in such a way that the separate pallet portions do not include platform halves, and that a number of different configurations are possible. For example, as is indicated in broken outline at 78 in FIG. 4B, the first pallet portion may be formed by the substantially C-shaped platform 80, having platform arms 82 and 84 extending along the entire length of the outer skid planks 74, thereby providing a cut-out defined by the broken line 78 for positioning a second pallet portion 86 having a narrowed platform 88 supported on the intermediate skid plank 70 and bolted onto a pair of broadened side skid planks 90. This configuration allows the side walls 52 and 54 to be erected on the side rebates 55 prior to loading of the platform 80.

An advantage of the invention is that the split pallet allows the collapsible container to be manually loaded in two stages without placing undue strain on the backs of the loaders. In the first stage of loading, the loader is able to walk into the vacant loading zone 48 to load the semi-platform 22. The loading operation is facilitated by the fact that the semi-platform is raised by a height of approximately 150 mm relative to the feet of the loader, meaning that he does not have to bend down as far. In addition, the semi-platform only has a depth of approximately 0.4 m, which means that maximum forward bending of the loader is also significantly reduced.

I claim:

1. A collapsible container comprising a multi-sided base pallet assembly, and a plurality of side walls arranged to be fitted to the sides of the base pallet assembly, wherein the base pallet assembly comprises first and second detachably mountable pallet portions, with the second pallet portion being detachably mountable on top of the first pallet portion in a lapped configuration, the first pallet portion including a first raised platform and defining a walk-in loading zone adjacent the first pallet portion for pre-loading the first raised platform, and the second pallet portion including a second raised platform co-planar with the first raised platform and arranged to occupy the loading zone for subsequent loading of the second raised platform after pre-loading of the first raised platform.

2. A collapsible container according to claim 1 in which the first pallet portion comprises a pair of spaced apart lower skids defining opposed sides of the pallet assembly, a rear support spanning the spaced apart skids and defining an operatively rear end of the first pallet portion, and an intermediate support spanning the skids between intermediate portions thereof, with the first raised platform being mounted on the rear and intermediate supports, and the second pallet portion comprises a front support detachably mountable atop the operatively front ends of the skids, with the second raised platform extending between the front and intermediate supports.

3. A collapsible container according to claim 1 in which the first pallet portion comprises a pair of spaced apart lower skids defining opposed sides of the pallet assembly, wherein the first raised platform spans the rear portions of the skids, and the second pallet portion comprises a second raised platform which spans the front portions of the skids and is detachably mountable thereto.

4. A collapsible container according to claim 3 in which the first raised platform is substantially C-shaped, with arms which extend along the sides of the skids so as to define a cut-out within which the second raised platform of the second pallet portion can be located, the second pallet portion including an intermediate support skid mounted to the second raised platform.

5. A collapsible container according to claim 1 in which the first and second raised platforms in combination define an outer peripheral rebate within which the side walls can be located, and a plurality of L-shaped clamps are provided for detachably mounting the side walls to the first and second pallet portions and for mounting adjacent side edges of the side walls to one another via an array of mounting slots defined towards the outer periphery of each of the side walls.

6. A method of assembling and loading a collapsible container comprising the steps of providing a first pallet portion having a first raised platform, manually loading the first raised platform with cargo from a walk-in loading zone adjacent the first raised platform, mounting a second pallet portion on top of the first pallet portion in a lapped configuration, with a second raised platform of the second pallet portion occupying the loading zone and being substantially co-planar with the first raised platform and loading the second raised platform of the second pallet portion with cargo.

7. A method according to claim 6 which includes the step of mounting an operatively rear wall panel to a distal side of the first pallet portion prior to manual loading, the distal side being opposite the loading zone.

8. A method according to claim 7 which includes the subsequent steps, prior to or after manual loading of the first pallet portion, of mounting side walls or panels adjacent the rear wall to the sides of the first pallet portion, so as to define an access opening, closing the access opening with an operatively front wall or panel once the second pallet portion has been loaded, and fitting a top panel over the rear, side and front panels.

9. A split pallet assembly comprising first and second pallet portions and mounting means for detachably mounting the second pallet portion on top of the first pallet portion in a lapped configuration, the first pallet portion including a first raised platform supported on a pair of outer support skids and a walk-in loading zone surrounded by the first raised platform and the skids for preloading the first raised platform, and the second pallet portion including a second raised platform, the second pallet portion being detachably mountable atop the support skids whereby the second raised platform is co-planar with the first raised platform and arranged to occupy the loading zone after pre-loading of the first raised platform for subsequent loading of the second raised platform.

10. A split pallet assembly according to claim 9 in which the first raised platform and the second raised platform are provided with mating edges formed with inter-engaging formations for retaining them in a co-planar configuration.

* * * * *